US009020386B2

(12) United States Patent
Ikebata

(10) Patent No.: US 9,020,386 B2
(45) Date of Patent: Apr. 28, 2015

(54) IMAGE FORMING APPARATUS WITH BLOW-OFF PORT FACING BOTTOM PORTION OF THE IMAGE SCANNING SECTION

(71) Applicant: KYOCERA Document Solutions Inc., Osaka (JP)

(72) Inventor: Yoshiaki Ikebata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 135 days.

(21) Appl. No.: 13/779,105

(22) Filed: Feb. 27, 2013

(65) Prior Publication Data

US 2013/0223871 A1 Aug. 29, 2013

(30) Foreign Application Priority Data

Feb. 29, 2012 (JP) ..... 2012-043413

(51) Int. Cl.
*G03G 21/20* (2006.01)

(52) U.S. Cl.
CPC ..... *G03G 21/206* (2013.01)

(58) Field of Classification Search
CPC ..... G03G 21/206
USPC ..... 399/92, 406, 405
See application file for complete search history.

(56) References Cited

U.S. PATENT DOCUMENTS

| | | | | |
|---|---|---|---|---|
| 4,695,151 | A * | 9/1987 | Watanabe | 399/92 |
| 6,611,667 | B2 * | 8/2003 | Kaiho | 399/92 |
| 6,628,906 | B2 * | 9/2003 | Kimizuka | 399/92 |

FOREIGN PATENT DOCUMENTS

| | | | |
|---|---|---|---|
| DE | 102007024663 | A1 * | 12/2007 |
| JP | 5-88424 | | 4/1993 |
| JP | 11-272146 | | 10/1999 |
| JP | 2002-40907 | | 2/2002 |
| JP | 2002-297003 | | 10/2002 |
| JP | 2009-14825 | | 1/2009 |
| JP | 2009-251599 | | 10/2009 |
| JP | 2012155186 | A * | 8/2012 |

* cited by examiner

*Primary Examiner* — Susan Lee
(74) *Attorney, Agent, or Firm* — Gerald E. Hespos; Michael J. Porco; Matthew T. Hespos

(57) ABSTRACT

An image forming apparatus includes an image forming section, a housing, an image scanning section, an airflow generation section, a guiding air path, and a blow-off port. The image forming section forms an image on a sheet. The housing accommodates the image forming section therein. The image scanning section has a bottom portion and is disposed above the housing. The airflow generation section generates an airflow inside the housing. The guiding air path guides the airflow upward inside the housing. The blow-off port is communicated with the guiding air path and arranged so as to face the bottom portion of the image scanning section.

9 Claims, 13 Drawing Sheets

IMAGE FORMING APPARATUS WITH BLOW-OFF PORT FACING BOTTOM PORTION OF THE IMAGE SCANNING SECTION

The present application is based on Japanese Patent Application No. 2012-43413 filed on Feb. 29, 2012, in the Japanese Patent Office, the entire contents of which are hereby incorporated by reference.

BACKGROUND

The present disclosure relates to an image forming apparatus that performs an image forming process on sheets and relates to an image forming apparatus that has an image scanning section above an image forming section.

Image forming apparatuses such as copiers, multi-function peripherals (MFPs), and printers have an image scanning section that applies light onto original sheets from a light source, photoelectrically-converts the reflection light with an image scanning sensor, and outputs image data as electric signals. Heat generated by the light source results in an increase in the temperature of the image scanning section. The temperature increase causes the reduction of the scanning quality of the image scanning. For this reason, in an image forming apparatus in the related art, an intake fan and an exhaust duct are provided at the side walls of an image scanning section, and an airflow is supplied to the inside of the image scanning section by the intake fan. After cooling members inside the image scanning section, the air is exhausted from the exhaust duct.

In the related art, an airflow is supplied to the inside of an image scanning section to cool the same. On this occasion, there may be a case that outside dust or the like is also supplied to the inside of the image scanning section together with the airflow. In this case, the dust attached onto the optical components of the image scanning section renders the scanning images of the image scanning section defective. In addition, the installation of a complicated air path is required inside the image scanning section, which results in an increase in the number of the components.

It is an object of the present disclosure to reduce contamination inside an image scanning section and prevent an increase in the temperature of the image scanning section.

SUMMARY

An image forming apparatus according to an aspect of the present disclosure includes an image forming section, a housing, an image scanning section, an airflow generation section, a guiding air path, and a blow-off port. The image forming section forms an image on a sheet. The housing accommodates the image forming section therein. The image scanning section has a bottom portion and is disposed above the housing. The airflow generation section generates an airflow inside the housing. The guiding air path guides the airflow upward inside the housing. The blow-off port is communicated with the guiding air path and arranged so as to face the bottom portion of the image scanning section.

DETAILED DESCRIPTION

Figure 1:
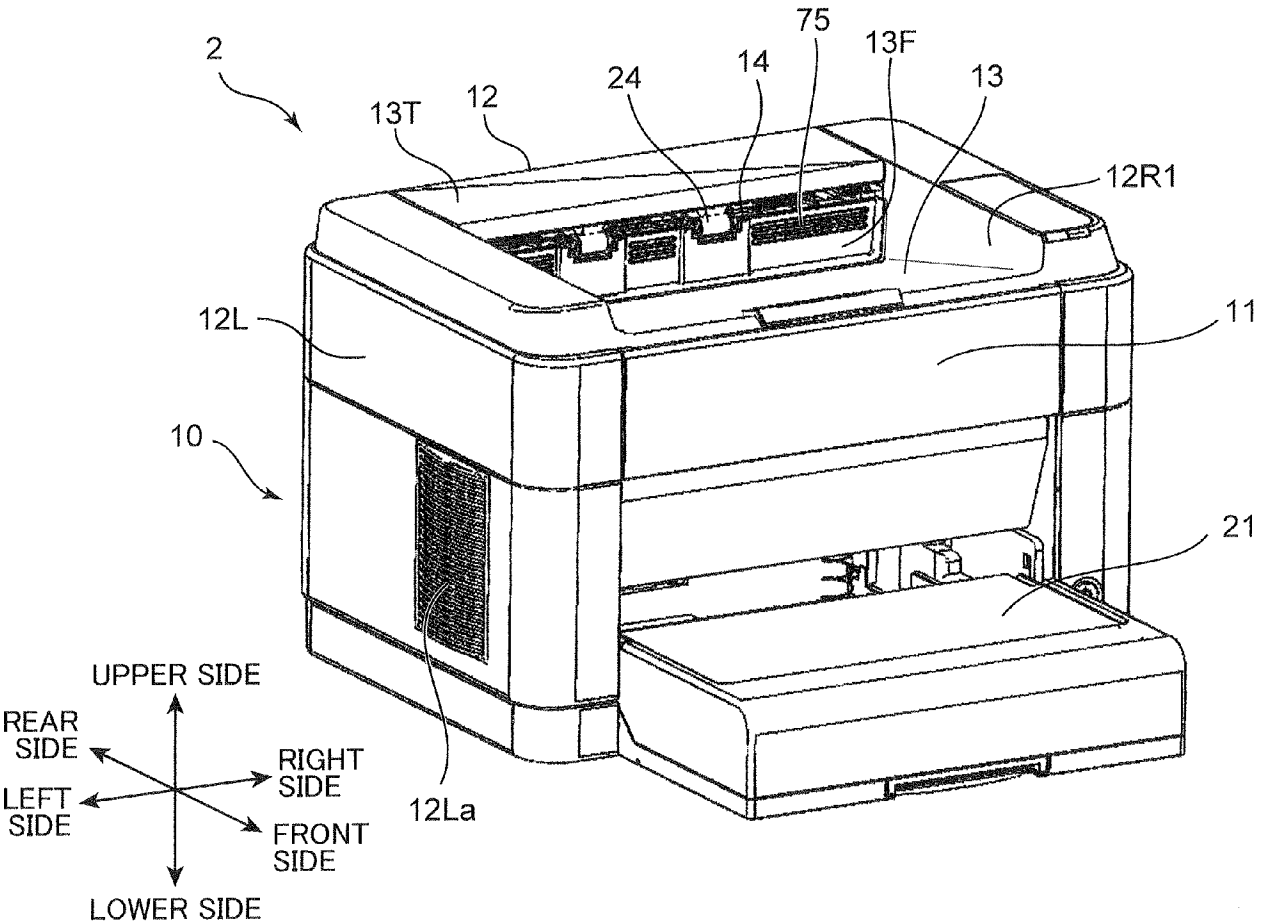
FIG. 1 is a perspective view showing the appearance of the apparatus main body of an image forming apparatus according to an embodiment of the present disclosure.
Figure 2:
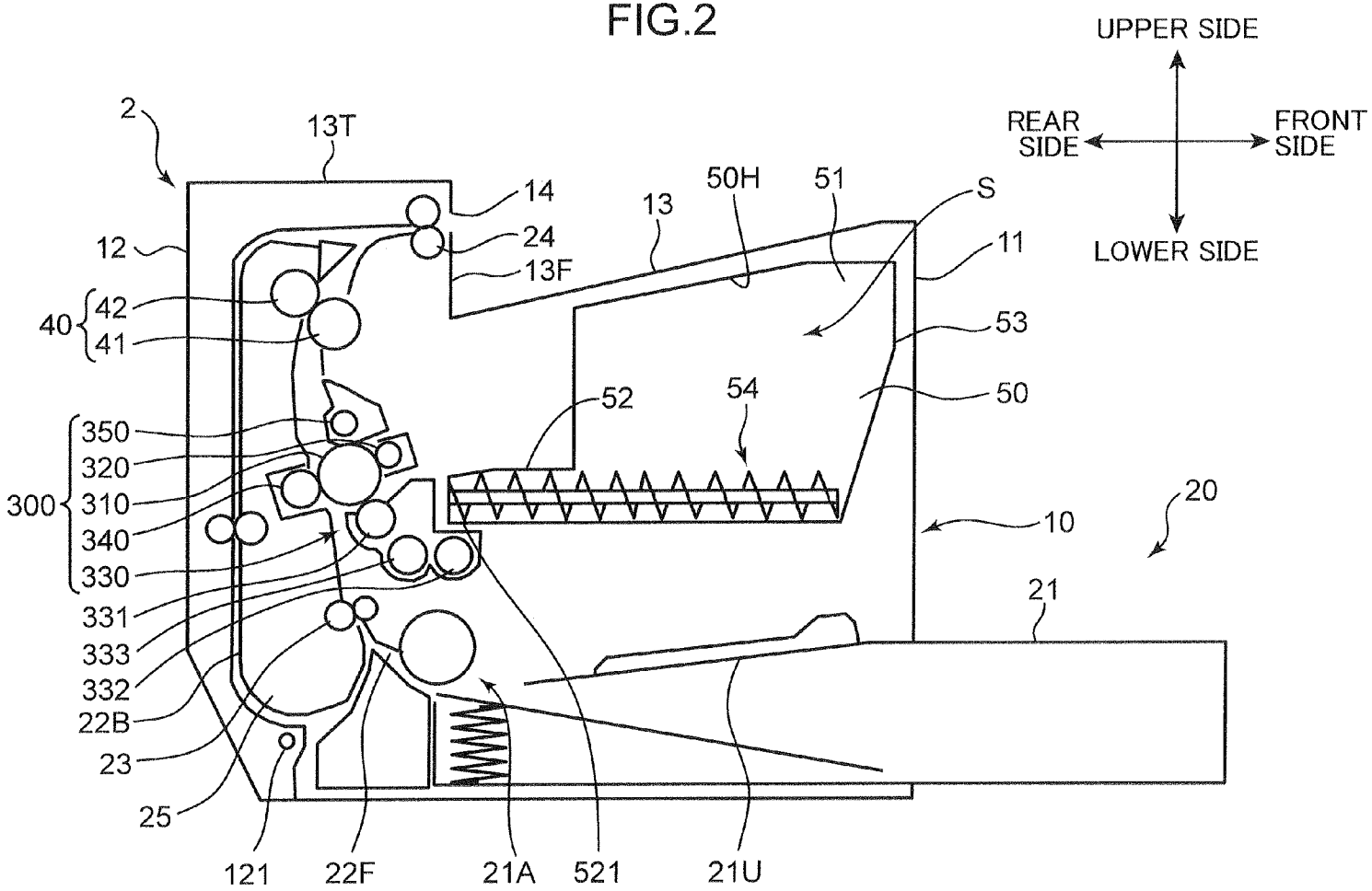
FIG. 2 is a side cross-sectional view showing the inner structure of the apparatus main body.
Figure 3:
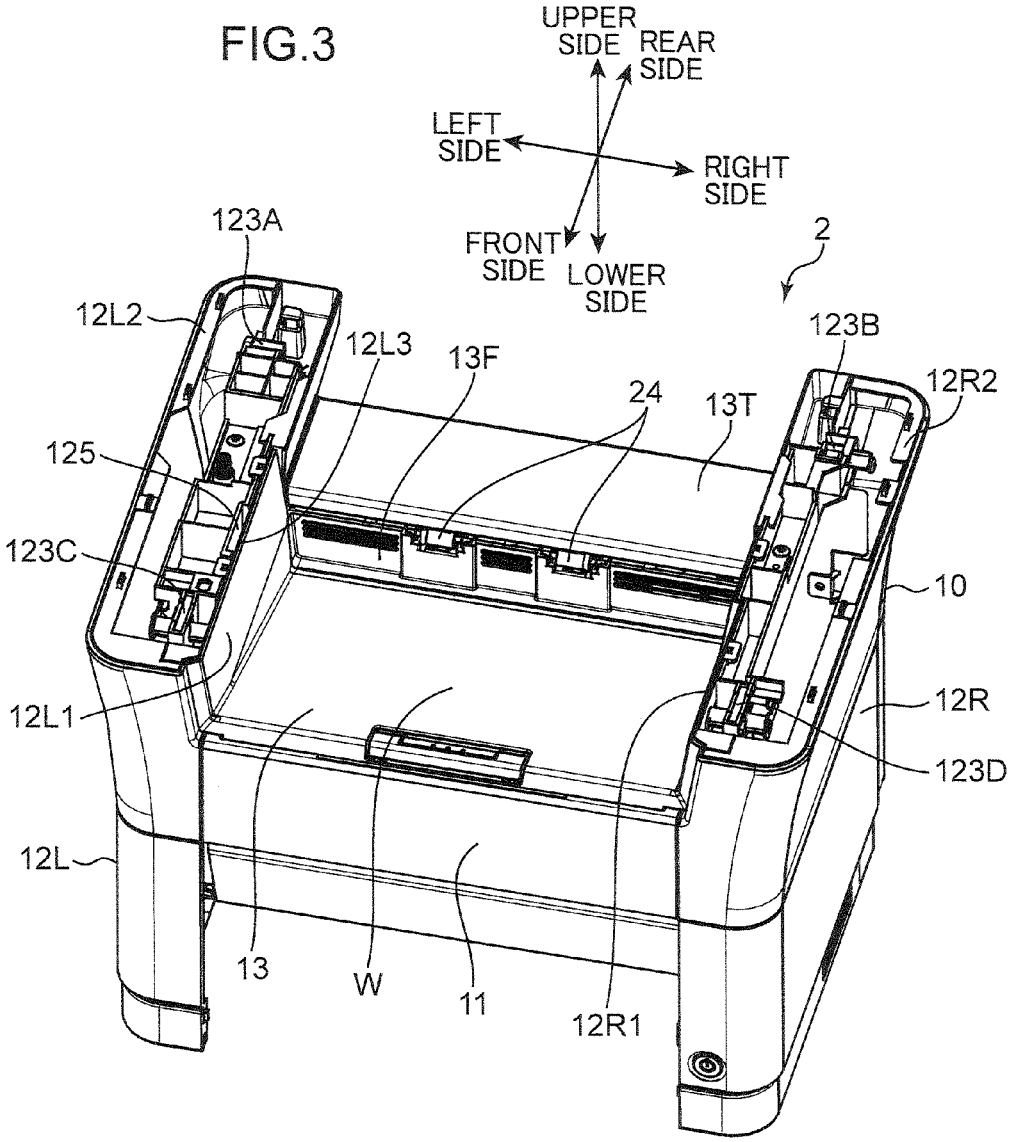
FIG. 3 is a perspective view of the apparatus main body as seen from the upper side thereof.
Figure 4:
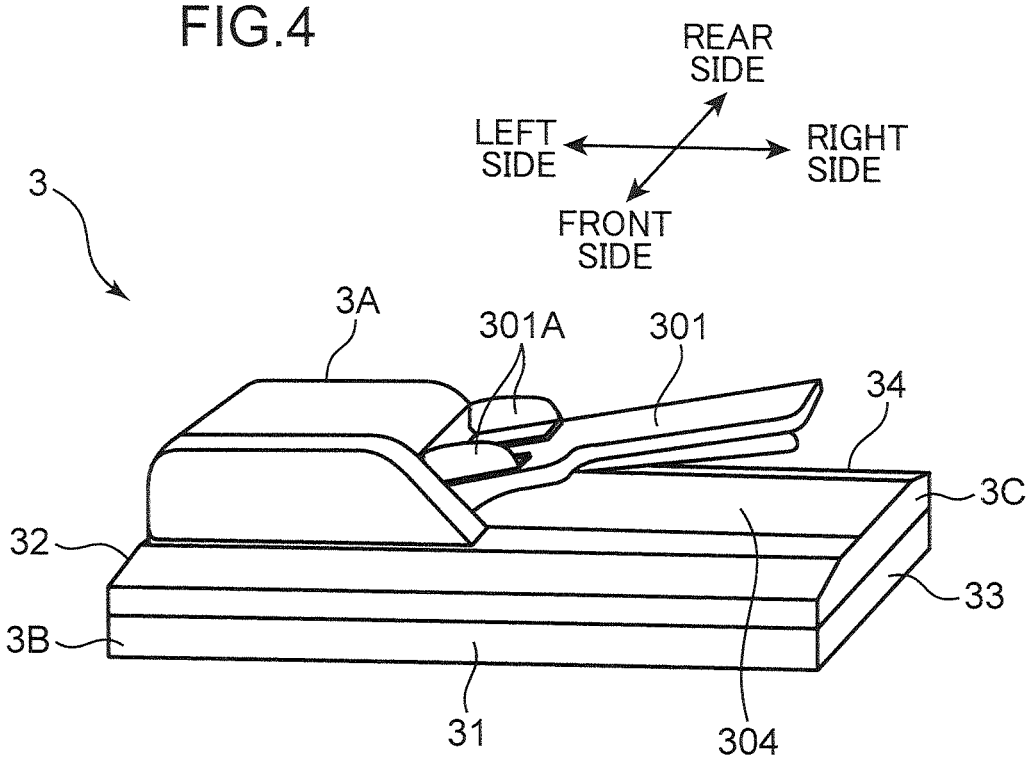
FIG. 4 is a perspective view of an image scanning apparatus according to the embodiment of the present disclosure as seen from the upper side thereof.
Figure 5:
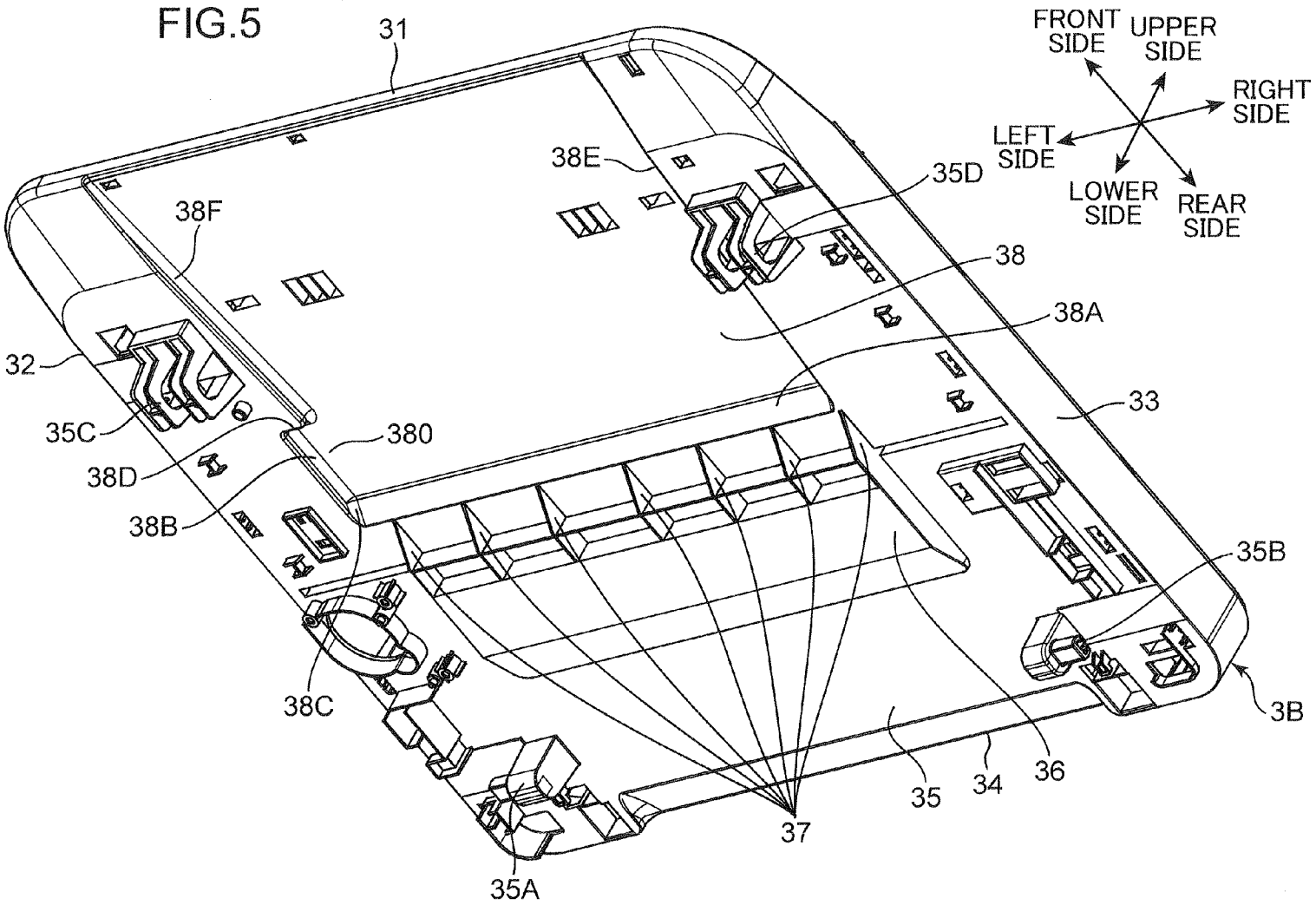
FIG. 5 is a perspective view of the image scanning apparatus as seen from the lower side thereof.

Hereinafter, embodiments of the present disclosure will be described in detail based on the drawings. FIG. 1 is a perspective view showing the appearance of an apparatus main body of an image forming apparatus 1 according to an embodiment of the present disclosure. FIG. 2 is a side cross-sectional view showing the inner structure of the apparatus main body 2. FIG. 3 is a perspective view of the apparatus main body 2 as seen from the upper side thereof. FIG. 4 is a perspective view of an image scanning apparatus 3. FIG. 5 is a perspective view of the image scanning apparatus 3 as seen from the lower side thereof. The image forming apparatus 1 is assembled in such a manner that the image scanning apparatus 3 is mounted on the apparatus main body 2. The image forming apparatus 1 according to the embodiment is so-called an in-body sheet-discharge-type image forming apparatus. Here, a monochrome printer is exemplified as the image forming apparatus 1, but the image forming apparatus may be a copier, a facsimile machine, an MFP having the functions of these apparatuses, or an image forming apparatus that forms color images.

The apparatus main body 2 includes a main body housing (housing) having a substantially-rectangular housing structure, a sheet feeding unit 20 accommodated inside the main body housing 10, an image forming section 300, a fixing unit 40, and a toner container 50.

The main body housing 10 has a front cover 11 on the front surface side thereof and a rear cover 12 on the rear surface side thereof. When the front cover 11 is opened, the toner container 50 shown in FIG. 2 is exposed. Thus, the user can remove the toner container 50 from the front surface side of the main body housing 10 if toner becomes exhausted. The rear cover 12 is a cover to be opened at sheet jamming or maintenance. The respective units of the image forming section 300 and the fixing unit 40 are removable from the rear surface side of the main body housing 10 when the rear cover 12 is opened.

On the side surfaces of the main body housing 10, a left cover 12L (FIG. 1) and a right cover 12R (not shown in FIG. 1) on the side opposite to the left cover 12L are disposed so as to extend in the vertical direction. The left cover 12L has, on the front side thereof, an intake port 12La through which a cooling fan 12Lb that will be described later takes in air. The main body housing 10 has, at the upper surface thereof, a sheet discharge portion 13 that catches sheets having images formed thereon (sheets having been subjected to a fixing process). An area positioned at the upper surface of the main body housing 10 and over the fixing unit 40 is defined by a rear upper-surface part 13T. Inside inner space S (FIG. 2) defined by the front cover 11, the rear cover 12, the left cover 12L, the right cover 12R, the sheet discharge portion 13, and the rear upper-surface part 13T, various units for use in performing an image forming process are housed.

The sheet feeding unit 20 includes a sheet feeding cassette 21 that accommodates therein sheets to be subjected to the image forming process (FIG. 2). Part of the sheet feeding cassette 21 protrudes frontward from the front surface of the main body housing 10. Of the sheet feeding cassette 21, the upper surface of part accommodated inside the main body housing 10 is covered with a top plate 21U of the sheet feeding cassette 21. The sheet feeding cassette 21 has sheet accommodation space that accommodates a stack of sheets therein, a lift plate that lifts up the stack of sheets for feeding, and the like. The sheet feeding cassette 21 has a sheet drawing part 21A over the rear end side thereof. The sheet drawing part 21A has a pickup roller (not shown) that individually draws uppermost one of the stack of sheets inside the sheet feeding cassette 21.

The image forming section 300 performs the image forming process in which toner images are formed on the sheets fed out from the sheet feeding unit 20. The image forming section 300 includes a photosensitive drum 310 (image bearing member), a charging unit 320, an exposure unit (not shown in FIG. 2), a development unit 330, a transfer roller 340, and a cleaning unit 350. The charging unit 320, the exposure unit, the development unit 330, the transfer roller 340, and the cleaning unit 350 are arranged at the periphery of the photosensitive drum 310. The image forming section 300 is disposed between the left cover 12L and the right cover 12R.

The photosensitive drum 310 rotates about the shaft thereof, and electrostatic latent images and toner images are formed on the peripheral surface of the photosensitive drum 310. As the photosensitive drum 310, a photosensitive drum made of an amorphous-silicon-(a-Si)-based material may be used. The charging unit 320 uniformly charges the front surface of the photosensitive drum 310 and includes a charging roller that comes in contact with the photosensitive drum 310. The cleaning unit 350 has a cleaning blade and the like, cleans toner attached onto the peripheral surface of the photosensitive drum 310 from which toner images have been transferred, and conveys the toner to a collection unit (not shown).

The exposure unit has a laser light source and optical equipment such as a mirror and a lens and applies laser light onto the peripheral surface of the photosensitive drum 310 to form electrostatic latent images thereon. The laser light is modulated based on the image data of original images scanned by the image scanning apparatus 3 that will be described later or based on image data supplied from external apparatuses such as personal computers. The development unit 330 supplies toner to the peripheral surface of the photosensitive drum 310 to develop electrostatic latent images on the photosensitive drum 310 and form toner images. The development unit 330 includes a development roller 331 that supports the toner to be supplied to the photosensitive drum 310 and includes first and second conveyance screws 332 and 333 that circulate and convey a developer inside a development housing by stirring the same.

The transfer roller 340 (toner image forming section) is a roller that transfers toner images formed on the peripheral surface of the photosensitive drum 310 onto sheets and constitutes a transfer nip portion with the photosensitive drum 310. To the transfer roller 340, a transfer bias having a polarity opposite to that of toner is applied.

The fixing unit 40 performs the fixing process in which transferred toner images are fixed onto sheets. The fixing unit 40 includes a fixing roller 41 having a heating source therein and a pressure roller 42 that is brought into press contact with the fixing roller 41 and constitutes a fixing nip portion with the fixing roller 41. When sheets having toner images transferred thereon are caused to pass through the fixing nip portion, the toner images are fixed onto the sheets by the heating of the fixing roller 41 and the pressure of the pressure roller 42.

The toner container 50 stores therein toner to be supplied to the development unit 330. The toner container 50 includes a container main body 51 that serves as a main storage area for the toner, a cylindrical part 52 that is provided so as to protrude from the lower part of one side surface of the container main body 51, a cover member 53 that covers another side surface of the container main body 51, and a rotation member 54 that is accommodated inside the toner container 50 and conveys the toner. When the rotation member 54 is caused to rotate and drive, the toner stored inside the toner container 50 is supplied into the development unit 330 from a toner ejection port 521 provided at the lower surface of the tip end of the cylindrical part 52. A top plate 50H of the toner container 50 that covers an area over the toner container 50 is positioned under the sheet discharge portion 13 (see FIG. 2).

The main body housing 10 has a main conveyance path 22F and a reverse conveyance path 22B therein to convey sheets. The main conveyance path 22F extends from the sheet drawing part 21A of the sheet feeding unit 20 via the image forming section 300 and the fixing unit 40 to a sheet discharge port 14 provided so as to face the sheet discharge portion 13 at the upper surface of the main body housing 10. The reverse conveyance path 22B is a conveyance path that returns, when both side printing is performed on sheets, the sheets having been performed to one-side printing to the upstream side of the image forming section 300 in the main conveyance path 22F.

In the main conveyance path 22F, a pair of resist rollers 23 is arranged upstream of the transfer nip portion constituted by the photosensitive drum 310 and the transfer roller 340. The sheets are temporarily stopped by the pair of resist rollers 23 for skew correction and then fed to the transfer nip portion at a prescribed timing for image transfer. At the appropriate places of the main conveyance path 22F and the reverse conveyance path 22B, a plurality of conveyance rollers is arranged to convey the sheets. For example, a pair of sheet discharge rollers 24 is arranged near the sheet discharge port 14.

The reverse conveyance path 22B is formed between the outside surface of a reverse unit 25 and the inner surface of the rear cover 12 of the main body housing 10. Note that at the inside surface of the reverse unit 25, the transfer roller 340 and one of the pair of resist rollers 23 are mounted. The rear cover 12 and the reverse unit 25 are each rotatable about the shaft of a supporting point part 121 provided at the lower end of the rear cover 12 and the reverse unit 25. If sheet jamming occurs in the reverse conveyance path 22B, the rear cover 12 is opened. If sheet jamming occurs in the main conveyance path 22F or when the unit of the photosensitive drum 310 and the development unit 330 are removed to the outside, the reverse unit 25 is also opened together with the rear cover 12.

As shown in FIG. 3, the main body housing 10 has a left inner-wall portion 12L1 on the inner side of the left cover 12L. The main body housing 10 has a right inner-wall portion 12R1 on the inner side of the right cover 12R. The left inner-wall portion 12L1 is a wall part disposed on the side (right side) opposite to the left cover 12L. The lower end of the left inner-wall portion 12L1 is connected to the sheet discharge portion 13. The right inner-wall portion 12R1 is a wall part disposed on the side (left side) opposite to the right cover 12R. The lower end of the right inner-wall portion 12R1 is also connected to the sheet discharge portion 13. Behind the sheet discharge portion 13, there is arranged a standing wall 13F provided so as to stand in the vertical direction thereof. The standing wall 13F connects the rear end of the sheet discharge portion 13 and the front end of the rear upper-surface portion 13T to each other. The standing wall 13F is provided with the pair of sheet discharge rollers 24.

The left cover 12L and the left inner-wall portion 12L1 are connected to each other by a left fixing surface 12L2 on the upper side thereof. The right cover 12R and the right inner-wall portion 12R1 are connected to each other by a right fixing surface 12R2 on the upper side thereof. The image scanning apparatus 3 that will be described later is mounted on the left fixing surface 12L2 and the right fixing surface 12R2. When the image scanning apparatus 3 covers the apparatus main body 2 from above, an in-body sheet discharge portion W is formed by the lower surface of the image scanning apparatus 3, the left inner-wall portion 12L1, the sheet discharge portion 13, the standing wall 13F, and the right inner-wall portion 12R1.

A first bearing part 123A and a first fixing unit 123C are arranged at the left fixing surface 12L2. A second bearing part 123B and a second fixing unit 123D are arranged at the right fixing surface 12R2. The first bearing part 123A and the second bearing part 123B are cylindrical bearing parts provided so as to extend in the right-and-left direction. The first fixing unit 123C and the second fixing unit 123D have a hole part formed so as to extend in the right-and-left direction. The first bearing part 123A, the second bearing part 123B, the first fixing unit 123C, and the second fixing unit 123D are used when the image scanning apparatus 3 is fixed onto the apparatus main body 2.

As shown in FIG. 4, the image scanning apparatus 3 is mounted on the upper surface of the apparatus main body 2. The image scanning apparatus 3 is composed of a conveyance section 3A, a scanning section 3B (image scanning section), and an original pressing section 3C. The conveyance section 3A automatically feeds original sheets (original sheet conveyed) for copying toward a prescribed original scanning position in the apparatus main body 2. On the other hand, when the user manually sets original sheets at the prescribed original scanning position, the conveyance section 3A and the original pressing section 3C are opened upward in an integrated manner about a rotation shaft (not shown) arranged at the rear end in a state in which the scanning section 3B is fixed onto the apparatus main body 2.

The conveyance section 3A has an original tray 301, original guides 301A, and an original sheet discharge tray 304. In addition, the conveyance section 3A has a sheet conveyance path that will be described later.

The original tray 301 is a tray on which original sheets to be fed to the image scanning position are set, and is arranged so as to extend from the right side of the conveyance section 3A. The original guides 301A are arranged in pairs in the front-and-rear direction of the original tray 301 to adjust the widths of set original sheets. The original sheet discharge tray 304 is a tray that catches original sheets from which original images have been optically scanned. The upper surface of the original pressing section 3C serves as the original sheet discharge tray 304.

The original pressing section 3C is a plate-like member that supports the conveyance section 3A from below. The original pressing section 3C can be held in an open state or a closed state in the upper-and-lower direction relative to the scanning section 3B. The original pressing section 3C has the function of pressing fixed originals set on the scanning section 3B from above.

Figure 8:
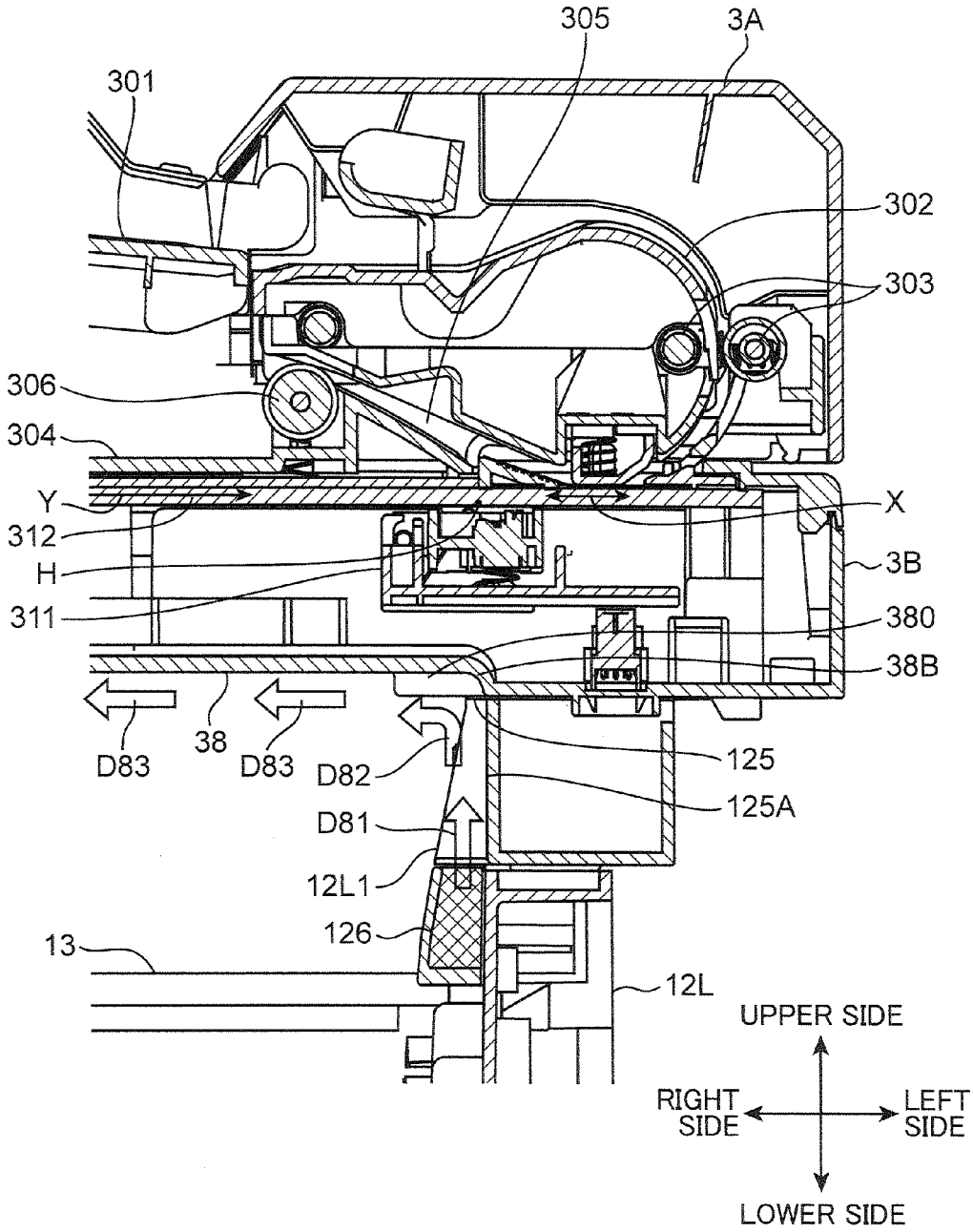
FIG. 8 is an enlarged cross-sectional view of the image forming apparatus as seen from the rear side thereof.

The scanning section 3B is arranged at the lower part of the image scanning apparatus 3. At the upper surface of the scanning section 3B at which the original pressing section 3C faces, an original glass board 312 is arranged (FIG. 8). The user sets fixed original sheet on the original glass board 312. The scanning section 3B has a scanning unit 311 (FIG. 8). The scanning unit 311 has a light source (not shown) and an image scanning sensor. Light is applied from the light source onto the original sheet, the reflection light is photo-electrically converted by the image scanning sensor, and image data is output as electric signals. The electric signals of image data are transmitted to the exposure unit, and electrostatic latent images are formed on the photosensitive drum 310.

As shown in FIG. 5, the scanning section 3B has a lower surface part 35 (bottom portion) that is a substantially-rectangular bottom surface, a scanning-section front wall 31, a scanning-section left wall 32, a scanning-section right wall 33, and a scanning-section rear wall 34. The scanning-section front wall 31, the scanning-section left wall 32, the scanning-section right wall 33, and the scanning-section rear wall 34 are provided so as to stand upward from the four sides of the lower surface part 35. The lower surface part 35 has, on the front side thereof, a front bottom-surface part 38 that is formed by making a dent in the lower surface part 35 from the scanning-section front wall 31 toward the central part of the lower surface part 35 in the front-and-rear direction. The rear end of the front bottom-surface part 38 is defined by a rear standing wall 38A and connected to the rear side of the lower surface part 35. The right and left sides of the front bottom-surface part 38 are defined by a right standing wall 38E and a left standing wall 38F, respectively. Note that the left standing wall 38F partially has, on the rear end side thereof, a concave part 380 (guiding part) notched in the left direction. The front side of the concave part 380 is defined by a front standing wall 38D, the left side thereof is defined by a concave-part left standing wall 38B, and the rear side thereof is defined by a rear standing-wall left end 38C that corresponds to part of the rear standing wall 38A. The front bottom-surface part 38 formed on the front side of the lower surface part 35 enhances the rigidity of the scanning section 3B.

On the rear side of the front bottom-surface part 38, a downward raising part 36 is arranged that is formed by raising part of the lower surface part 35 downward. Further, a plurality of ribs 37 is arranged in the left-and-right direction between the downward raising part 36 and the front bottom-surface part 38. The downward raising part 36 and the ribs 37 enhance the rigidity of the lower surface part 35. Moreover, on the front side of the lower surface part 35 and on the right-and-left outsides of the front bottom-surface part 38, a first insertion part 35C and a second insertion part 35D are arranged, respectively. The first insertion part 35C and the second insertion part 35D each have a pair of protruding pieces arranged at an interval therebetween, and the protruding pieces have a hole part that penetrates in the right-and-left direction. At the rear end of the lower surface part 35 and near the insides of the scanning-section left wall 32 and the scanning section right wall 33, a first shaft part 35A and a second shaft part 35B are arranged, respectively. The first shaft part 35A and the second shaft part 35B each have a shaft shape provided so as to extend toward the outside in the right-and-left direction.

The first shaft part 35A and the second shaft part 35B formed at the lower surface part 35 of the image scanning apparatus 3 are fitted in the first bearing part 123A and the second bearing part 123B of the apparatus main body 2, respectively. The first insertion part 35C and the second insertion part 35D are fitted in the first fixing part 123C and the second fixing part 123D of the apparatus main body 2, respectively, and fixing pins (not shown) are put between these parts. As a result, the image scanning apparatus 3 is mounted on the apparatus main body 2. The front bottom-surface part 38 of the lower surface part 35 of the image scanning apparatus 3 covers the sheet discharge portion 13 of the apparatus main body 2 from above. That is, the front bottom-surface part 38 defines the upper surface of the in-body sheet discharge portion W formed at the upper surface of the apparatus main body 2. In other words, the sheet discharge portion 13 of the apparatus main body 2 is disposed at the upper surface part of the main body housing 10 with space interposed between the sheet discharge portion 13 and the front bottom-surface part 38 (lower surface part 35) of the scanning section 3B. On this occasion, the left standing wall 38F of the image scanning apparatus 3 is arranged on an inner-wall upper end 12L3 of the apparatus main body 2.

As described above, the scanning unit 311 is arranged inside the scanning section 3B (FIG. 8). Heat generated by the light source disposed in the scanning unit 311 results in an increase in the temperature of the scanning section 3B. The temperature increase causes the reduction of the scanning quality of the scanning section 3B. In a case in which an intake fan and an exhaust duct are provided at the side walls of the scanning section 3B to reduce the temperature increase, an airflow is supplied to the inside of the scanning section 3B by the intake fan to cool the inside of the scanning section 3B. However, there may be a case that outside dust or the like is also supplied to the inside of the scanning section 3B together with an airflow when the airflow is supplied to the inside of the scanning section 3B. As a result, the dust attached onto the optical components of the scanning section 3B renders the scanning images of the scanning section 3B defective.

Figure 6:
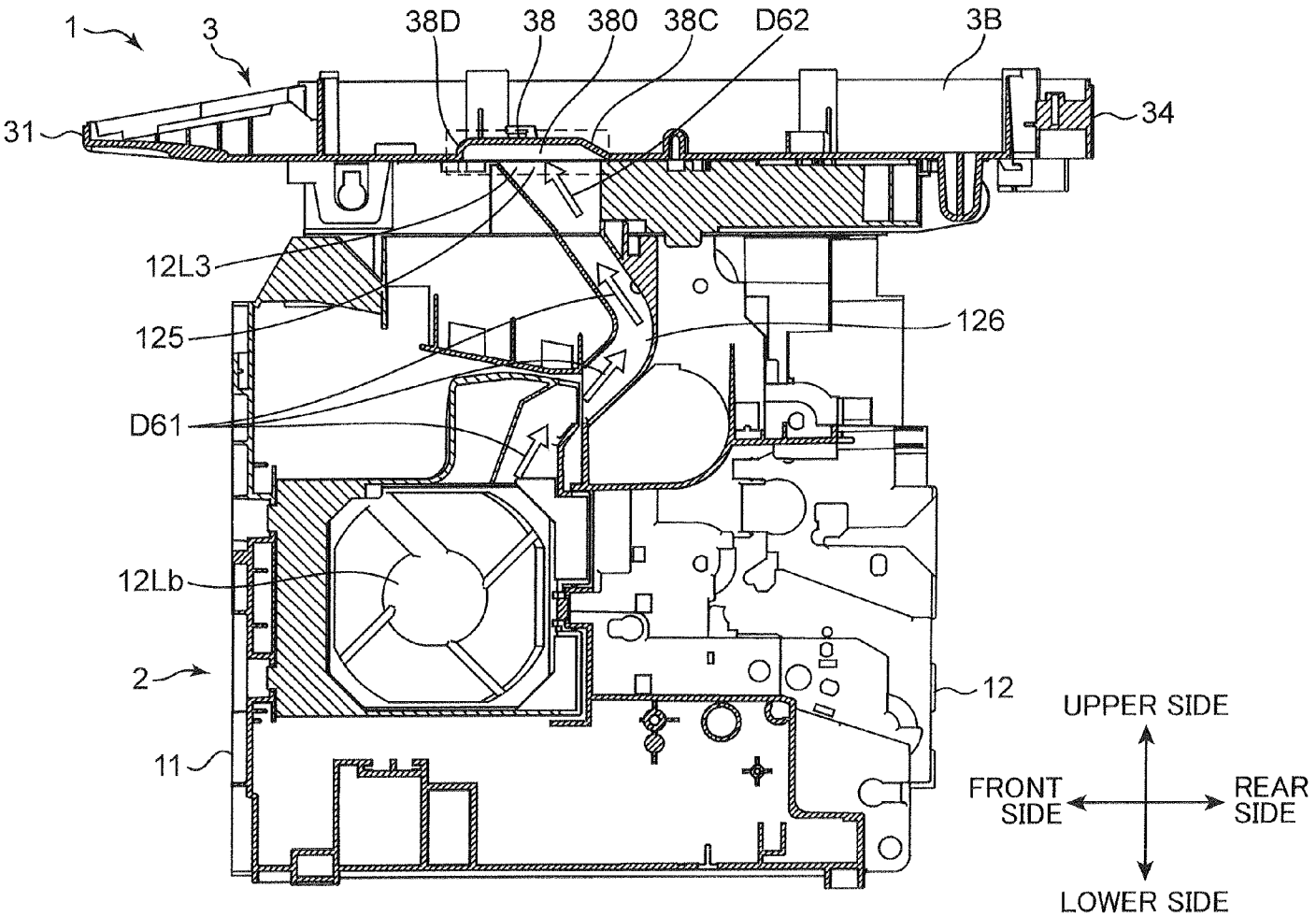
FIG. 6 is a side cross-sectional view of the image forming apparatus according to the embodiment of the present disclosure.
Figure 7:
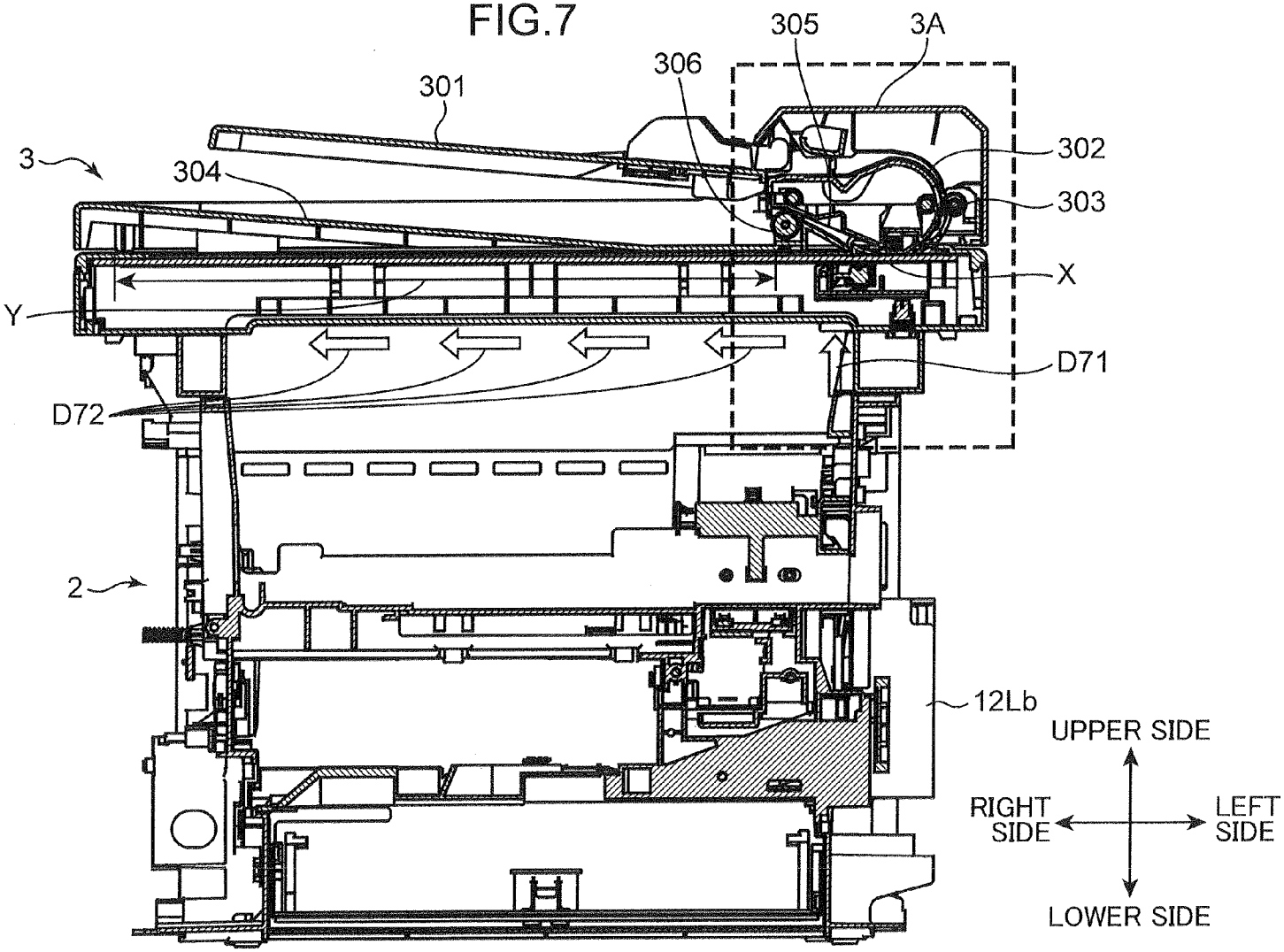
FIG. 7 is a cross-sectional view of the image forming apparatus as seen from the rear side thereof.
Figure 9:
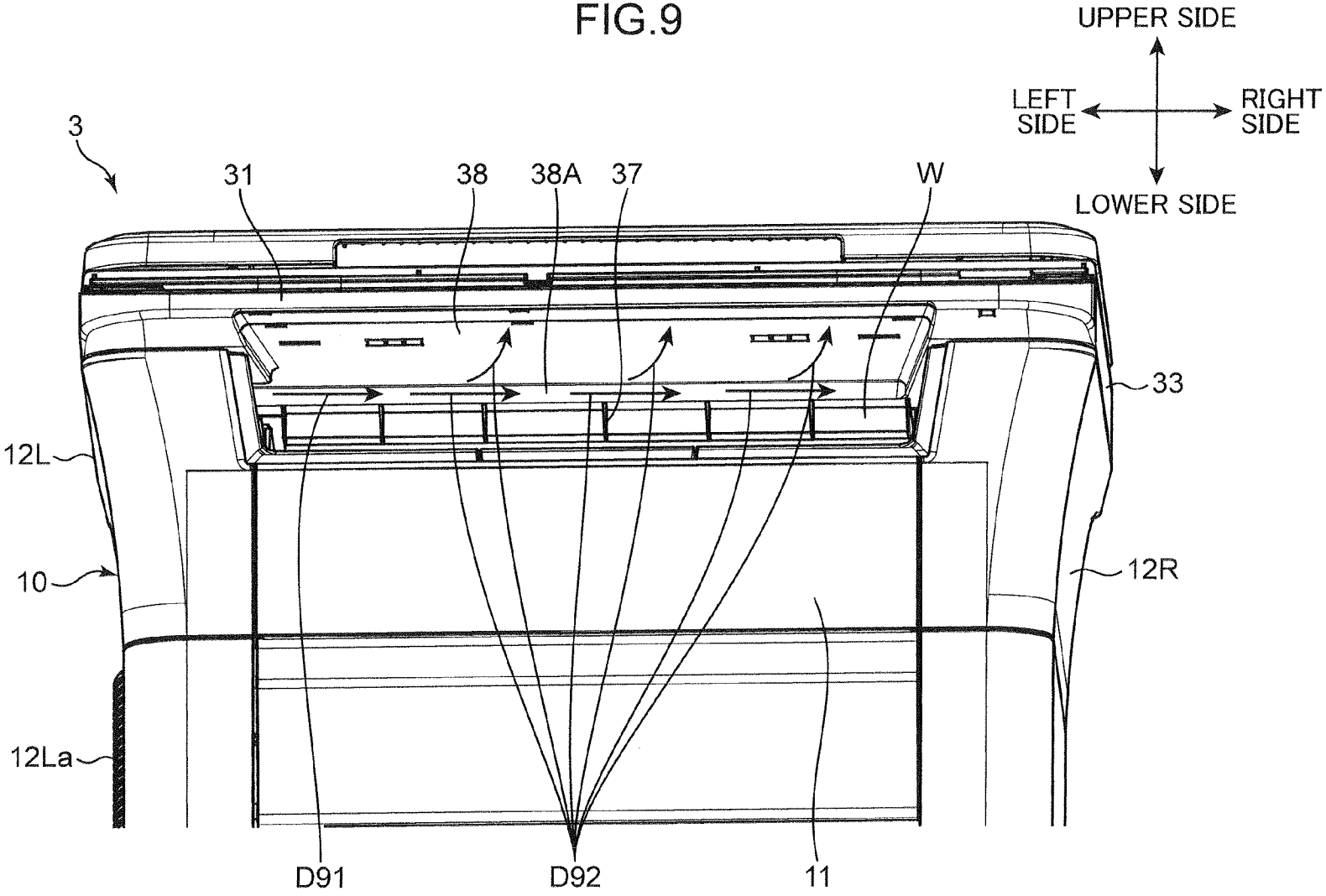
FIG. 9 is a perspective view of the image forming apparatus as seen from the front lower side thereof.
Figure 10:
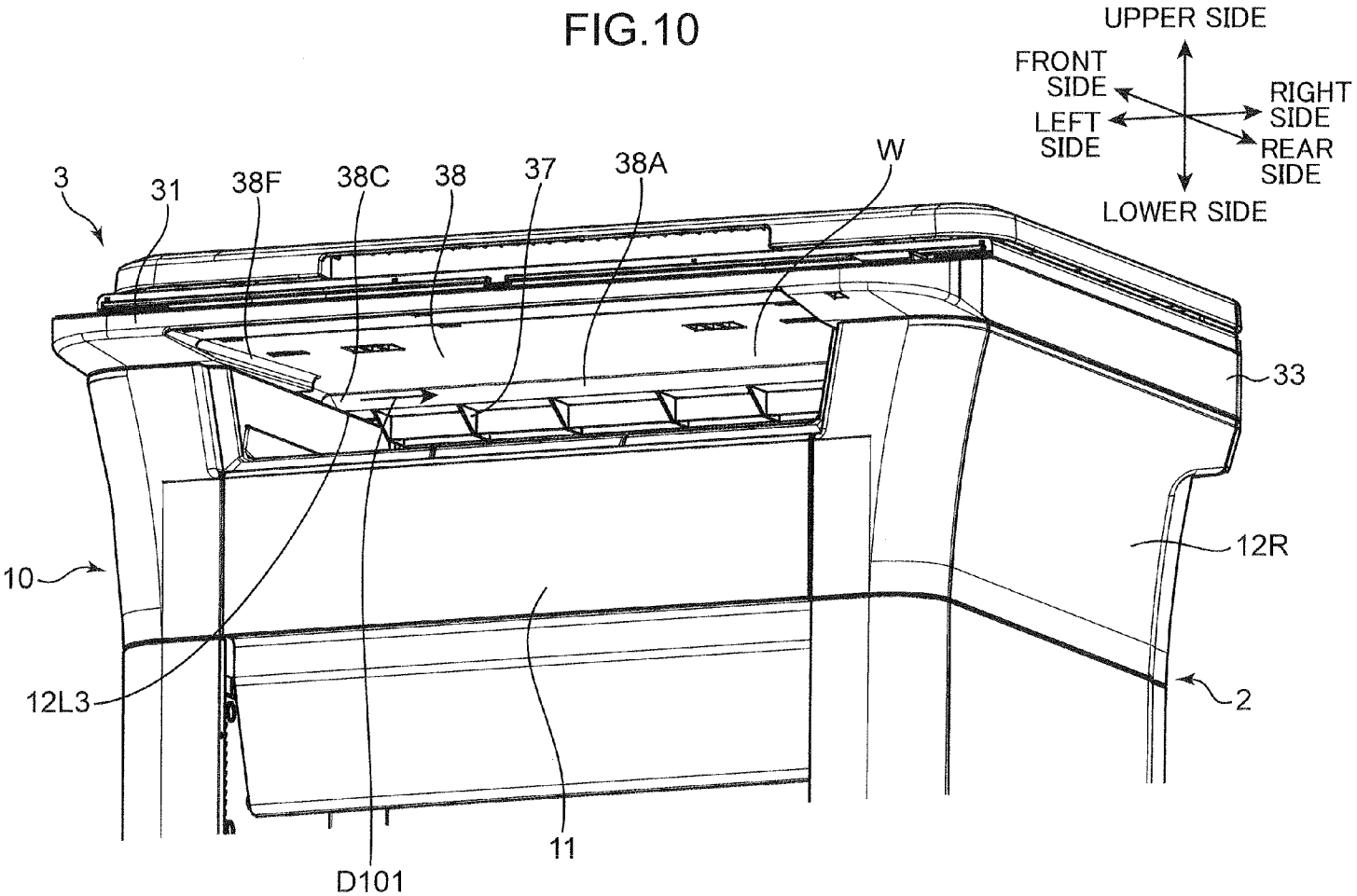
FIG. 10 is a perspective view of the image forming apparatus as seen from the front lower side thereof.
Figure 11:
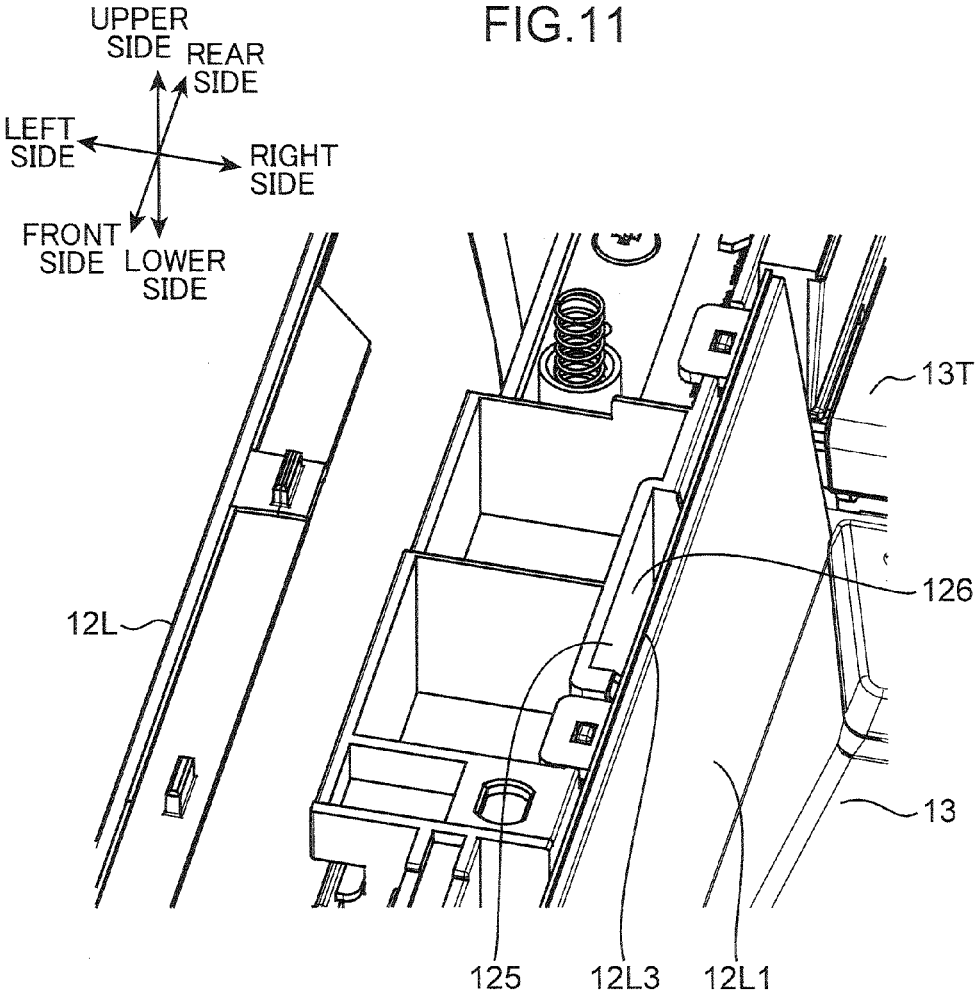
FIG. 11 is an enlarged perspective view of the apparatus main body as seen from the upper side thereof.

In order to solve the above problem, the scanning section 3B is suitably cooled without providing a cooling fan inside the scanning section 3B according to the embodiment. Next, a cooling air path according to the embodiment will be described in detail. FIG. 6 is a side cross-sectional view of the image forming apparatus 1 as seen from the right side thereof. FIG. 7 is a cross-sectional view of the image forming apparatus 1 as seen from the rear side thereof. FIG. 8 is a cross-sectional view in which part of the image forming apparatus 1 shown in FIG. 7 is enlarged. FIGS. 9 and 10 are perspective views of the image forming apparatus 1 as seen from the front lower side thereof. Moreover, FIG. 11 is a view in which part of the perspective view (FIG. 3) of the apparatus main body 2 as seen from the upper side thereof is enlarged.

As shown in FIG. 6, the apparatus main body 2 of the image forming apparatus 1 has the cooling fan 12Lb that generates an airflow inside the main body housing 10, a cooling air path 126 that faces the cooling fan 12Lb at one end thereof and guides the airflow to the upper side, and an opening part 125 (blow-off port) provided at the other end of the cooling air path 126. Note that the opening part 125 is only required to communicate with the cooling air path 126 and is not necessarily provided at the end of the cooling air path 126.

The cooling fan 12Lb (airflow generation section) is disposed inside the intake port 12La shown in FIG. 1. The cooling fan 12Lb is a rotation-type fan and has a rotation shaft, a motor, and a plurality of blade members (not shown). The cooling fan 12Lb rotates as a driving current is supplied from a power source (not shown) to the motor, and forms a rotation surface parallel to the left cover 12L (FIG. 1) during rotation. With the rotation of the cooling fan 12Lb, air outside of the main body housing 10 is taken in via the intake port 12La, and an airflow toward the inside of the main body housing 10 is generated.

The cooling air path 126 (guiding air path) is a duct provided inside the main body housing 10 so as to extend upward from the inside (right side, near side of the space of FIG. 6) of the cooling fan 12Lb. The cooling air path 126 has such a curved shape as to be inclined rearward and then inclined frontward as the cooling air path 126 extends upward. The cooling air path 126 guides the airflow in the upper direction inside the main body housing 10. The cooling air path 126 has the opening part 125 at the upper end thereof. Via the opening part 125, the airflow is blown toward the front bottom-surface part 38 of the scanning section 3B. Of the cooling air path 126, the right side surface nearest to the opening part 125 is defined by the left inner-wall portion 12L1 of the main body housing 10. In other words, the right side end edge of the opening part 125 is formed by the inner-wall upper end 12L3 (FIG. 11). In addition, of the cooling air path 126, the left side surface nearest to the opening part 125 is defined by an air-path inner-wall part 125A. The air-path inner-wall part 125A is connected to the concave-part left standing wall 38B of the scanning section 3B.

Moreover, the conveyance section 3A arranged on the scanning section 3B has, besides the original tray 301 and the original sheet discharge tray 304, a first conveyance path 302, a pair of first conveyance rollers 303, a second conveyance path 305, and a pair of second conveyance rollers 306. Further, the scanning section 3B has the scanning unit 311 and the original glass board 312.

The first conveyance path 302 is a sheet conveyance path that is provided so as to extend leftward in the horizontal direction from the left end of the original tray 301 and is then formed into a substantially semi-circular shape. The first conveyance path 302 is a conveyance path for conveying sheets set on the original tray 301 to a first scanning part X (first scanning region). The pair of first conveyance rollers 303 is disposed in the middle of the first conveyance path 302. The pair of first conveyance rollers 303 conveys sheets to the first scanning part X. The first scanning part X is a scanning region having a slight width in the right-and-left direction. At the first scanning part X, the images of original sheets conveyed on the original glass board 312 are scanned with the scanning unit 311 fixed. The second conveyance path 305 is a sheet conveyance path for conveying sheets, from which images have been scanned at the first scanning part X, to the original sheet discharge tray 304. The second conveyance path 305 is composed of an inclination surface inclined rightward and upward from the first scanning part X. The pair of second conveyance rollers 306 is arranged at the terminal end of the second conveyance path 305 and ejects sheets onto the original sheet discharge tray 304.

The original glass board 312 (original setting board) serves as the upper surface part of the scanning section 3B and is disposed at the position at which the original pressing section 3C (FIG. 4) faces. The original glass board 312 has a second scanning part Y (second scanning region) formed thereon. On the original glass board 312, original sheets whose images are to be scanned by the scanning unit 311 are set. The second scanning part Y is a scanning surface provided so as to extend in the right-and-left and front-and-rear directions, and is a region in which the scanning unit 311 is caused to move in the sub-scanning direction to scan the images of original sheets set on the original glass board 312.

The scanning unit 311 has the light source and the image scanning sensor and is formed into a long member that is long in the front-and-rear direction. The light source and the image scanning sensor are provided so as to extend in the front-and-rear direction (in the main scanning direction of the image scanning sensor) inside the scanning section 3B. The scanning unit 311 can be moved in the right-and-left direction (in the sub-scanning direction of the image scanning sensor) by a moving mechanism (not shown). The scanning unit 311 scans the images of original sheets conveyed by the conveyance section 3A in a state in which the scanning unit 311 is caused to move to an area beneath the first scanning part X. In addition, the scanning unit 311 scans the image of original sheet set on the original glass board 312 while being caused to move in the right-and-left direction at an area beneath the second scanning part Y on the right side of the first scanning part X.

When the image forming apparatus 1 is in a standby state, the scanning unit 311 is caused to move to a scanning standby position H. The scanning standby position H is set on the right side of the first scanning part X and over the concave-part left standing wall 38B (left standing wall 38F) (FIG. 5). Note that the scanning standby position H may be set right beneath the first scanning part X. Thus, inside the scanning section 3B, heat is generated by the scanning unit 311 serving as a heat source at the scanning standby position H or at the area beneath the first scanning part X or the second scanning part Y. Particularly when the scanning unit 311 scans the images of original sheets at the first scanning part X, peripheral members are likely to be heated since the position of the scanning unit 311 is fixed. In addition, when the scanning unit 311 is set at the scanning standby position H, the scanning unit 311 may operate to correct the output of the image scanning sensor in accordance with the use of the image forming apparatus 1. In this case, heat is also generated by the scanning unit 311.

In order to prevent the temperature of the scanning section 3B from increasing due to the heat generated by the scanning unit 311 arranged inside the scanning section 3B, an airflow is blown toward the scanning section 3B via the cooling air path 126. In FIG. 6, an airflow supplied into the main body housing 10 by the cooling fan 12Lb is directed to the upper side of the main body housing 10 via the cooling air path 126 (as shown by arrows D61 in FIG. 6, an arrow D71 in FIG. 7, and an arrow D81 in FIG. 8). Then, the airflow blown off from the opening part 125 is blown toward the concave part 380 (see FIG. 5) of the image scanning apparatus 3, which is positioned right over the opening part 125 (as shown by an arrow D62 in FIG. 6).

As described above, the scanning unit 311 is often arranged over the concave part 380. Therefore, the airflow is blown toward the lower surface part 35 corresponding to part whose temperature is likely to become particularly high in the scanning section 3B. That is, via the opening part 125, the airflow is blown toward a region close to the central area of the first scanning part X in the sub-scanning direction in the lower surface part 35 of the scanning section 3B. Thus, it becomes possible to suitably cool the scanning section 3B with an airflow.

Moreover, the airflow reaching the concave part 380 is caused to change the direction by the front bottom-surface part 38, the concave-part left standing wall 38B, the front standing wall 38D, and the rear standing-wall left end 38C that constitute the concave part 380, and moves in the right direction along the front bottom-surface part 38 (as shown by arrows D72 in FIG. 7, an arrow D82 and arrows D83 in FIG. 8, an arrow D91 in FIG. 9, and an arrow D101 in FIG. 10). That is, the concave part 380 is disposed so as to face the opening part 125 and guides the airflow in the direction from the first scanning part X toward the second scanning part Y. Particularly, since the concave-part left standing wall 38B is a curved surface that curves and extends in the direction from the first scanning part X toward the second scanning part Y, the airflow suitably moves in the right direction. Then, the airflow is diffused frontward while moving in the right direction (as shown by arrows D92 in FIG. 9), whereby the lower surface part 35 and the exposed area of the front bottom-surface part 38 of the scanning section 3B are cooled.

Figure 12:
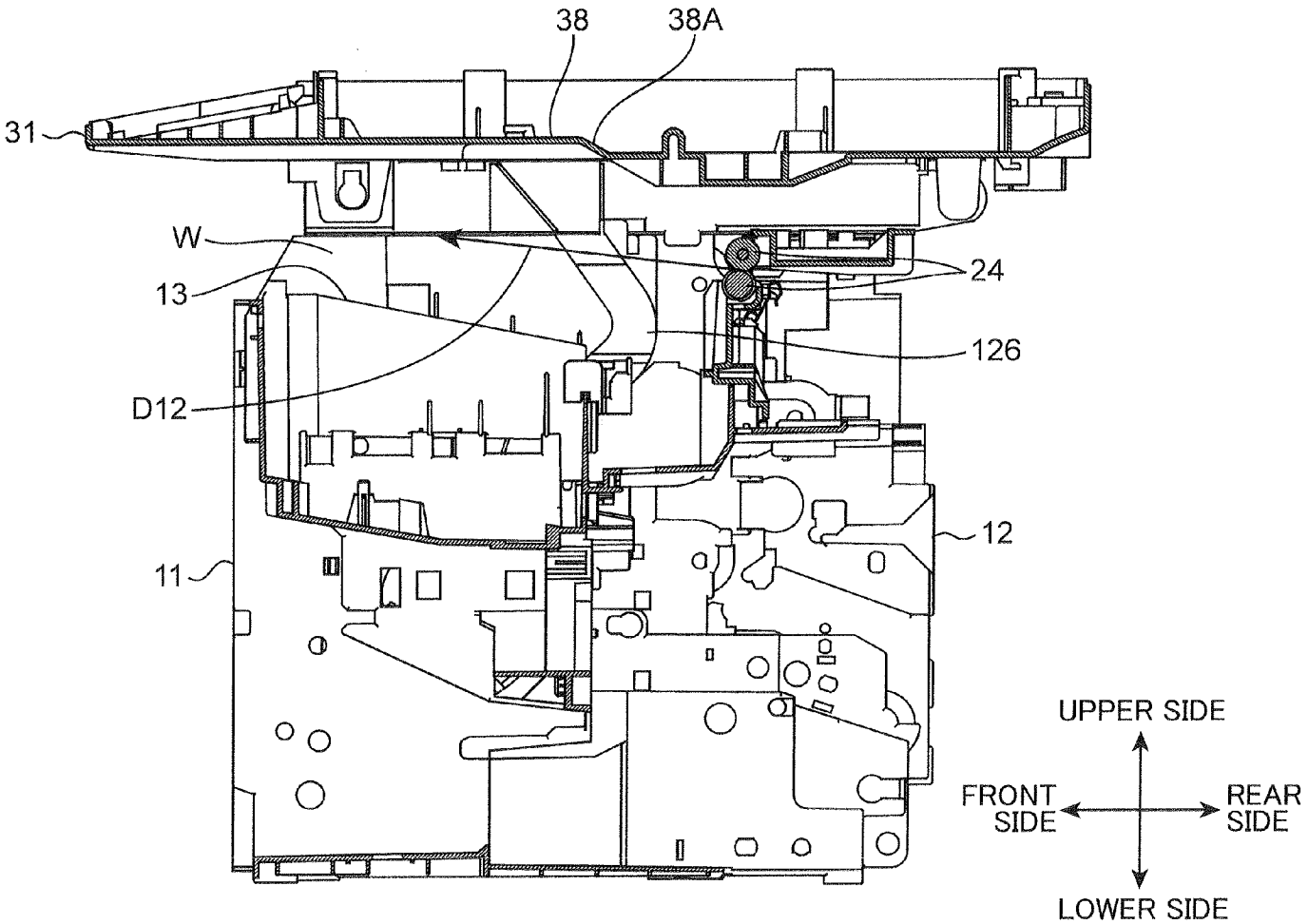
FIG. 12 is a side cross-sectional view of the image forming apparatus.
Figure 13:
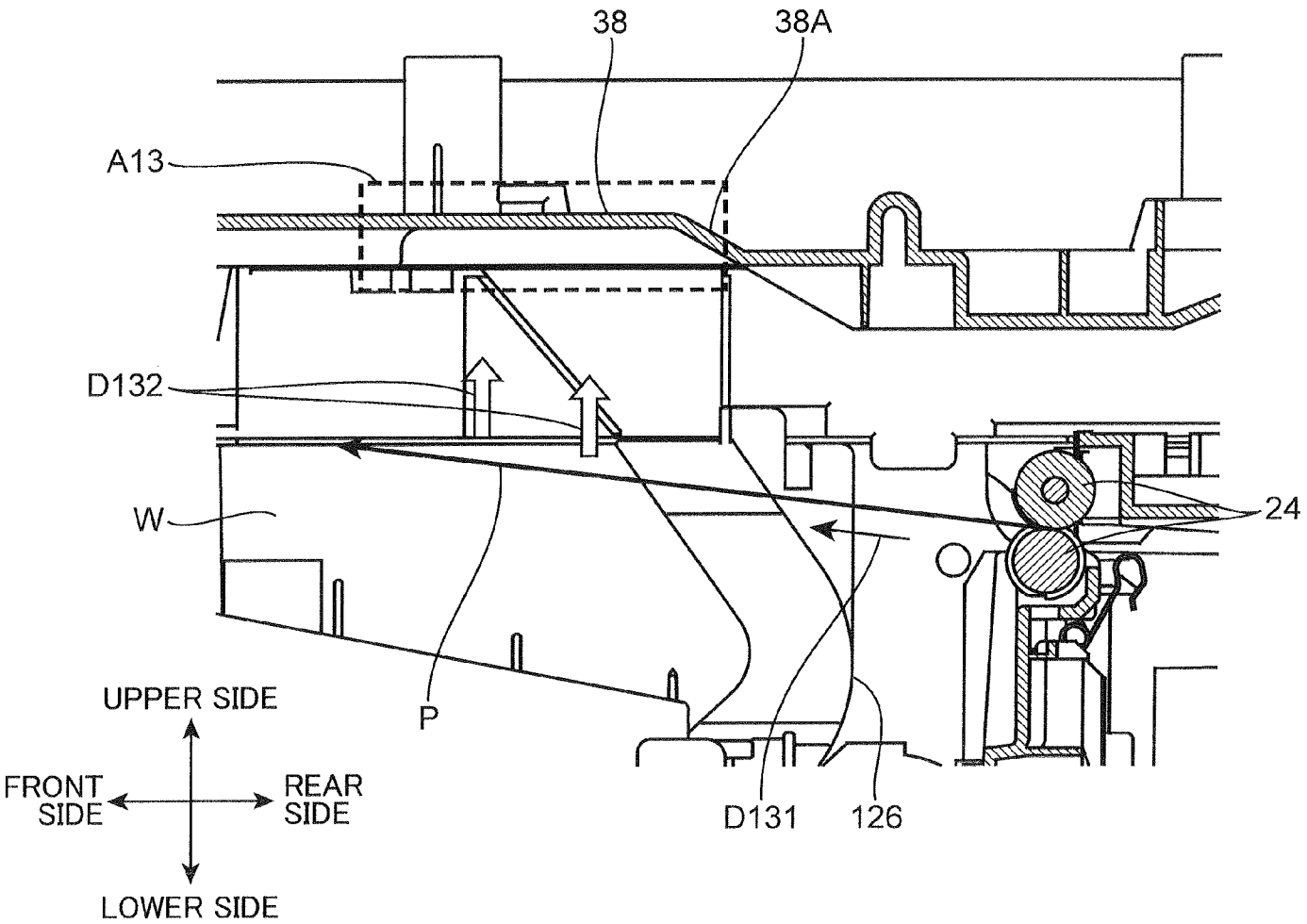
FIG. 13 is a cross-sectional view in which part of the side cross-sectional view of the image forming apparatus is enlarged.

Flowing of an airflow blown off from the opening part 125 along the front bottom-surface part 38 as described above produces further functions and effects. FIG. 12 is a cross-sectional view of the image forming apparatus 1 as seen from the right side thereof. FIG. 13 is a cross-sectional view in which part of the image forming apparatus 1 shown in FIG. 12 is enlarged. When the image forming process is performed by the image forming apparatus 1, sheets P having toner fixed thereon through heating by the fixing unit 40 are discharged to the sheet discharge portion 13 (in-body sheet discharge portion W) by the pair of sheet discharge rollers 24. On this occasion, as shown in FIG. 13, the remaining heat of the sheets P produces warm air toward an area over the sheet discharge portion 13 (as shown by arrows D132). The warm air warms up the scanning section 3B from underneath. Even in this case, an airflow blown off from the opening part 125 flows along the front bottom-surface part 38 according to the embodiment. Therefore, there is produced an effect that the heat of the uprising warm air is insulated by the airflow under the lower surface part 35 of the scanning section 3B.

Moreover, according to the embodiment, the airflow (as shown by the arrow D91 in FIG. 9) blown off from the opening part 125 is supplied in the direction orthogonal to the direction (i.e., direction crossing the sub-scanning direction in the embodiment) (as shown by an arrow D131 in FIG. 13) in which the pair of sheet discharge rollers 24 discharges the sheets P. Therefore, the airflow hardly acts as headwind for the sheets P discharged from the pair of sheet discharge rollers 24. That is, the airflow hardly prevents the discharge of the sheets P from the pair of sheet discharge rollers 24.

As described above, the scanning section 3B is suitably cooled by an airflow supplied from the cooling air path 126 of the apparatus main body 2 to the front bottom-surface part 38 of the scanning section 3B according to the embodiment. On this occasion, the airflow is blown toward the concave part 380 of the front bottom-surface part 38 via the opening part 125 of the apparatus main body 2. The concave part 380 is arranged near the first scanning part X of the scanning section 3B. The area right beneath or near the first scanning part X is easily heated by the scanning unit 311 since the scanning unit 311 is fixed and arranged at the area for a long period of time. Accordingly, an airflow is blown toward part whose temperature is likely to become particularly high in the scanning section 3B, whereby the scanning section 3B is suitably cooled.

In addition, via the opening part 125, an airflow is blown toward the region of the lower surface part 35 (front bottom-surface part 38) of the scanning section 3B in the main scanning direction of the scanning unit 311, the region corresponding to the central part of the scanning unit 311. Therefore, the airflow is diffused in the main scanning direction at the lower surface part 35 of the scanning section 3B, whereby the lower surface part 35 (front bottom-surface part 38) is suitably cooled.

In order to turn the airflow blown toward the lower surface part 35 from the cooling air path 126 in the right direction, the front bottom-surface part 38 is formed in which an upward dent is made in part of the lower surface part 35 according to the embodiment. Of the cooling air path 126, the right side surface nearest to the opening part 125 is defined by the left inner-wall portion 12L1 of the main body housing 10. The opening part 125 is opened upward, and the right-side end edge of the opening part 125 is defined by the inner-wall upper end 12L3 that serves as the upper end of the left inner-wall portion 12L1 (FIG. 3). In addition, of the cooling air path 126, the left side surface nearest to the opening part 125 is defined by the air-path inner-wall part 125A, and the air-path inner-wall part 125A is connected to the concave-part left standing wall 38B of the scanning section 3B. The opening part 125 is arranged along the inner-wall upper end 12L3 on the side opposite to the sheet discharge portion 13 relative to the inner-wall upper end 12L3.

As a result, as shown in FIG. 10, the inner-wall upper end 12L3 is linearly arranged in the front-and-rear direction when seen by the user of the image forming apparatus 1, and the opening part 125 is not exposed to the in-body sheet discharge portion W. Therefore, the in-body sheet discharge portion W does not have a complicated shape. In addition, since the left inner-wall portion 12L1 as well as the right inner-wall portion 12R1 forming the inner-wall portion of the main body housing 10 do not have a complicated shape, manufacturing costs are reduced. Further, since an airflow is not directly blown toward the sheet discharge portion 13 when the operator removes sheets discharged to the sheet discharge portion 13, the removing operation of the sheets is hardly hindered.

Moreover, the airflow flowing along the front bottom-surface part 38 isolates the scanning section 3B from the warm air generated by sheets P caught by the in-body sheet discharge portion W. Accordingly, an increase in the temperature of the scanning section 3B due to the heat generated by sheets P besides the heat generated by the scanning unit 311 can be effectively reduced. In addition, an airflow blown off from the opening part 125 is supplied in the direction orthogonal to the discharging direction of sheets P. Therefore, the airflow does not hinder the discharge of sheets P by the pair of sheet discharge rollers 24.

Further, since a fan that cools the scanning section 3B is not provided in the scanning section 3B according to the embodiment, the miniaturization of the scanning section 3B is made possible.

The image forming apparatus 1 having the cooling air path according to the embodiment of the present disclosure is described above, but the present disclosure is not limited to this and may employ, for example, the following modified embodiments.

(1) According to the above embodiment, the cooling fan 12Lb is used to generate an airflow inside the main body housing 10, but the present disclosure is not limited to this. An airflow may be generated by conveyance rollers that convey sheets inside the main body housing 10. That is, in FIG. 2, an air path (not shown) is communicated with part of the main conveyance path 22F (sheet conveyance path). When the pair of resist rollers 23 (sheet conveyance members) conveys sheets upward, a laminar flow is formed on the surfaces of the sheets. Flowing of the laminar flow from the main conveyance path 22F into the air path creates an airflow. Even with this configuration, an airflow is blown toward the front bottom-surface part 38 of the scanning section 3B via the opening part 125, whereby the scanning section 3B is suitably cooled.

(2) In addition, according to the above embodiment, the image scanning apparatus 3 is configured to have the conveyance section 3A, but the present disclosure is not limited to this. The image forming apparatus 3 may not be configured to have the conveyance section 3A as an image scanning section. In this case, the original pressing section 3C and the scanning section 3B are arranged over the main body housing 10. The original glass board disposed at the upper surface of the scanning section 3B has only a scanning region that corresponds to the second scanning part Y. Even in this case, the lower surface part 35 (front bottom-surface part 38) of the scanning section 3B is suitably cooled by an airflow blown off from the opening part 125. The light source of the scanning unit 311 is likely to increase temperature under the second scanning part Y and around the standby position at which the scanning unit 311 is on standby. Accordingly, when an airflow is blown from the opening part 125 toward the region corresponding to the standby position of the lower surface part 35 of the scanning section 3B, the scanning section 3B is further suitably cooled.

According to the above embodiments of the present disclosure, there is provided an image forming apparatus capable of reducing contamination inside an image scanning section and suitably preventing an increase in the temperature of the image scanning section. Particularly, it becomes possible to cool the image scanning section without providing a dedicated cooling fan in the image scanning section positioned over a sheet discharge portion.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an image forming section that forms an image on a sheet;

a housing that accommodates the image forming section therein;

an image scanning section that has a bottom portion and is disposed above the housing, the image scanning section including:

an original setting board on which an original sheet is set;

a scanning unit that has a light source extending in a main scanning direction and movable in a sub-scanning direction;

a first scanning region on the original setting board and at which an image of an original sheet conveyed on the original setting board is scanned with the scanning unit fixed; and a second scanning region on the original setting board and at which an image of a fixed original sheet set on the original setting board is scanned with the scanning unit being moved in the sub-scanning direction;

an airflow generation section that generates an airflow inside the housing;

a guiding air path that guides the airflow upward inside the housing; and a blow-off port that is communicated with the guiding air path and arranged so as to face the bottom portion of the image scanning section, the blow-off port facing a region of the bottom portion of the image scanning section that is close to a central portion of the first scanning region in the sub-scanning direction.

2. The image forming apparatus according to claim 1, wherein the image forming section includes:

a toner image forming unit that transfers a toner image onto a sheet; and a fixing unit that performs a fixing process to fix the toner image on the sheet, the image forming apparatus further comprising:

a sheet discharge portion that is disposed at an upper surface portion of the housing with a space interposed between the sheet discharge portion and the bottom portion of the image scanning section and catches the sheet for which the fixing process has been performed.

3. The image forming apparatus according to claim 2, wherein the bottom portion of the image scanning section includes a guiding part that is disposed so as to face the blow-off port and guides the airflow in a direction from the first scanning region toward the second scanning region.

4. The image forming apparatus according to claim 3, wherein the guiding part is a concave part disposed at the bottom portion of the image scanning section so as to face the blow-off port, and the concave part has a wall part that extends in the direction in which the airflow is caused to move from the first scanning region to the second scanning region.

5. The image forming apparatus according to claim 3, further comprising:

a conveyance roller that conveys the sheet for which the fixing process has been performed in a direction orthogonal to the direction in which the airflow is guided by the guiding part, and causes the sheet to reach the sheet discharge portion.

6. The image forming apparatus according to claim 1, wherein the blow-off port is arranged so as to face a region of the bottom portion of the image scanning section, the region facing a central portion of the scanning unit in the main scanning direction.

7. The image forming apparatus according to claim 1, wherein the airflow generation section is a rotation-type fan disposed in the housing.

8. The image forming apparatus according to claim 1, wherein the airflow generation section includes:

a sheet conveyance path that is disposed inside the housing and communicated with the guiding air path; and a sheet conveyance member that conveys the sheet via the sheet conveyance path and generates a laminar flow along a surface of the sheet.

9. The image forming apparatus according to claim 4, wherein the housing includes a pair of inner-wall portions that is provided so as to stand at both ends of the sheet discharge portion in the sub-scanning direction and supports the scanning unit, the sheet discharge portion is an in-body sheet discharge portion surrounded by the pair of inner-wall portions and the bottom portion of the image scanning section, the blow-off port is arranged along an upper end edge of one of the inner-wall portions on a side opposite to the sheet discharge portion relative to the upper end edge so as to face the bottom portion of the image scanning section, and the concave part is disposed at the bottom portion of the image scanning section so as to cover an area over the sheet discharge portion.

* * * * *